United States Patent [19]

Tsuda et al.

[11] 4,249,999

[45] Feb. 10, 1981

[54] ELECTROLYTIC ZINC-NICKEL ALLOY PLATING

[75] Inventors: Tetsuaki Tsuda; Tatsuo Kurimoto, both of Osaka, Japan

[73] Assignee: Sumitomo Metal Industries, Ltd., Osaka, Japan

[21] Appl. No.: 130,184

[22] Filed: Mar. 13, 1980

[30] Foreign Application Priority Data

Mar. 30, 1979 [JP] Japan ..... 54-39190

[51] Int. Cl.[3] ..... C25D 3/56

[52] U.S. Cl. ..... 204/28; 204/27; 204/43 Z

[58] Field of Search ..... 204/43 Z, 43 T, 27, 204/28

[56] References Cited

U.S. PATENT DOCUMENTS

| | | | |
|---|---|---|---|
| 3,420,754 | 1/1969 | Roehl | 204/43 Z X |
| 3,558,442 | 1/1971 | Roehl et al. | 204/43 Z X |

*Primary Examiner*—G. L. Kaplan

*Attorney, Agent, or Firm*—Browdy and Neimark

[57] ABSTRACT

A steel strip is electrolytically plated with a Zn-Ni alloy in an electrolyte both containing $Zn^{2+}$ and $Ni^{2+}$ ions together with a strontium compound in an amount of 0.05–10 g/l, calculated as $SrSO_4$ is disclosed.

2 Claims, 2 Drawing Figures

ELECTROLYTIC ZINC-NICKEL ALLOY PLATING

Figure 1:
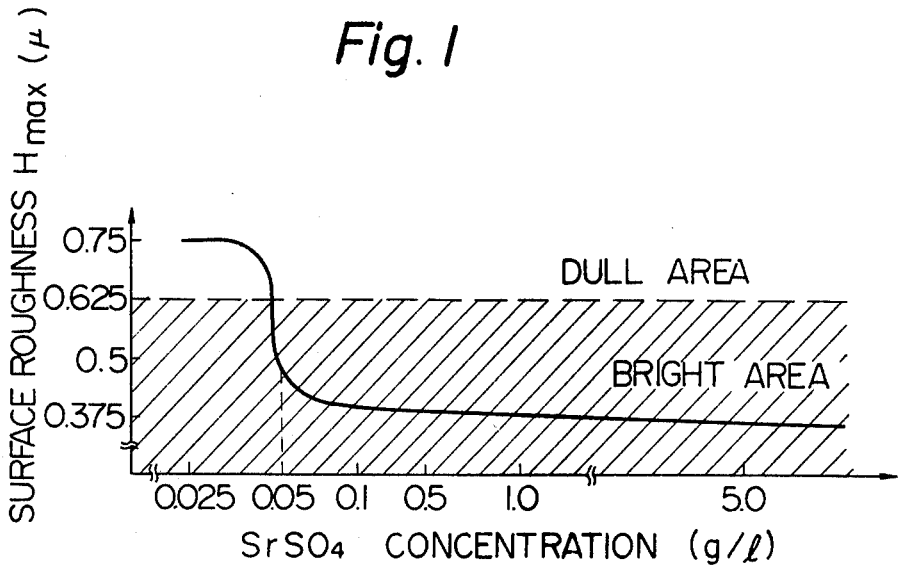

The present invention relates to the electrolytic plating of a steel strip with a Zn-Ni alloy to give excellent surface brightness.

Recently, since plating of high quality has been strongly desired, research and study on a variety of composite platings and alloy platings have been carried out. In the course of this research and study the usefulness of electrolytic Zn-Ni alloy plating has been proved. An electrolytically deposited Zn-Ni alloy coating shows much more resistance to corrosion than a single metal coating, such as of zinc. However, in case of an article having a large surface area to be plated, such as steel strip, the finish often is dull or of uneven brightness due to unavoidable fluctuation in plating conditions, such as current density, bath temperature, bath composition, pH and so on, particularly due to the contamination of plating bath during the operation. Thus, electrolytic Zn-Ni alloy plating has not yet been practiced commercially. Further progress in development is apparently required to enable putting the method into practice on an industrial scale.

In the prior art a variety of organic agents have been proposed as a brightener. See, for example, the article "METAL FINISHING" by Malathy Pushpavanam & B. A. Shenol, Vol. 25, 1977 pp. 29–34, and "The Canning Handbook on Electroplating" published by W. Canning Limited, second edition, 1978, pp. 382–387. However, since they are less resistive to corrosion, the resulting plating inevitably show less resistance to corrosion. In addition, they are unstable at a plating bath temperature of 40–70° C., so that the control of a plating bath is difficult.

The object of the present invention is to provide a method of electrolytically plating a steel strip with a Zn-Ni alloy layer having excellent surface brightness.

Another object of the present invention is to provide the electrolytic alloy plating method in which an excellent bright finish can be obtained regardless of the presence of contaminants in the electrolytic bath.

In view of the previously mentioned requirements in the art, the inventors of the present invention carried out various experiments and intensive study on electrolytic Zn-Ni ally plating with the aim in mind of providing a steel strip with a Zn-Ni alloy layer having excellent and uniform surface brightness regardless of fluctuation in plating conditions during the operation, particularly the presence of contaminants in the plating bath. The inventors found that it is possible to provide a steel strip with a Zn-Ni alloy coating having excellent and uniform surface brightness by adding strontium sulfate ($SrSO_4$) to the electrolyte.

Thus, the present invention is, in essence, characterized by carrying out electrolytic Zn-Ni alloy plating using a plating bath containing $Zn^{2+}$ ions and $Ni^{2+}$ ions together with $SrSO_4$ in an amount of 0.05–10 g/l.

More specifically, the present invention resides in a method of electrolytically alloy-plating a steel strip with a Zn-Ni alloy in an electrolyte containing $Zn^{2+}$ ions in an amount of 10–130 g/l and $Ni^{2+}$ ions in an amount of 20–140 g/l at a current density of 4–70 A/dm$^2$ while maintaining the bath temperature at 40°–70° C. and the pH at 1.0–4.5, characterized by adding a strontium compound in an amount of 0.05–10 g/l, calculated as $SrSO_4$, to the electrolyte.

The $SrSO_4$ added to the electrolyte may have the form of colloid in the plating bath. Though the mechanism is not fully understood, the reason the addition of $SrSO_4$ produces a plated article having excellent surface brightness is thought to be as follows.

Since in general an insoluble lead electrode is used as an anode in carrying out the Zn-Ni alloy plating, the Pb dissolves into the electrolyte during the plating operation. Though the amount dissolved is very small, the dissolved lead ions deposit on the surface of the article being processed, resulting in a dull plating. However, if colloidal $SrSO_4$ is present, it will adsorb $Pb^{2+}$ ions on its surface and the amount of free $Pb^{2+}$ ions will be kept below 5 ppm. Thus, the addition of $SrSO_4$ to the electrolyte may prevent the deposition of $Pb^{2+}$ ions, so that the electrolytic Zn-Ni alloy plating may produce a uniform deposition with a bright surface.

A strontium compound other than strontium sulfate ($SrSO_4$), such as strontium salt, e.g. $SrCO_3$, $Sr(OH)_2$ etc. may be used for the purpose of the present invention. These strontium salts also form $SrSO_4$ in the plating bath in the presence of $SO_4^{2-}$ ions.

A barium compound such as barium sulfate ($BaSO_4$) may be added to the electrolyte to obtain the same effect as the strontium compound. However, it has been confirmed that the strontium compound ($SrSO_4$) is more effective in providing the plated layer with excellent brightness. The soluble barium salts which may form $BaSO_4$ in the electrolyte are, in most cases, toxic, so that it is not desirable to handle the barium salt during the plating operation. Therefore, it is preferable to use a strontium salt for the purpose of the present invention.

The reason for restricting the amount of $SrSO_4$ to that in the present invention will be further explained on the basis of the data shown in FIG. 1.

FIG. 1 is a graph showing the relation between the content of $SrSO_4$ in the electrolyte and the surface roughness of the resulting plating.

The data shown in the graph in FIG. 1 were obtained as follows.

An electrolytic Zn-Ni alloy plating was carried out by using a plate of Pb-1.0%Sb alloy as an anode and a cold rolled steel strip as a cathode. The concentration of $SrSO_4$ in the electrolyte bath was varied as indicated in the graph. The surface brightness of the resulting plated steel strip was optically measured. The brightness was evaluated in terms of surface roughness determined in $H_{max}(\mu)$. The hatched area in the graph shows the area in which satisfactory brightness in visual inspection can be obtained (hereinafter referred to as "bright area").

Other plating conditions are as follows.

$ZnSO_4$:80 g/l ($Zn^{2+}$32.4 g/l)
$NiCl_2$: 140 g/l ($Ni^{2+}$63.2 g/l)
$NH_4Cl$: 30 g/l
pH: 2.2
Bath temperature: 50° C.
Current density: 20 A/dm$^2$
Coating weight: 20 g/m$^2$ As is apparent from the data shown in the graph, when the concentration of $SrSO_4$ is less than 0.05 g/l, surface brightness is not satisfactory, i.e. the surface roughness falls outside the bright area, but when the concentration is not less than 0.05 g/l, the effect of the addition of $SrSO_4$ is remarkable. On the other hand, at a concentration of more than 10 g/l, the added $SrSO_4$ settles and coagulates and adheres to the current-supplying roll, linger-roll and further to the steel strip being processed. The thus adhered precipitates cause indentation flaws to increase the percent of defective plated steel strips. Also, the addition of too much $SrSO_4$ makes the method less economical.

Figure 2:
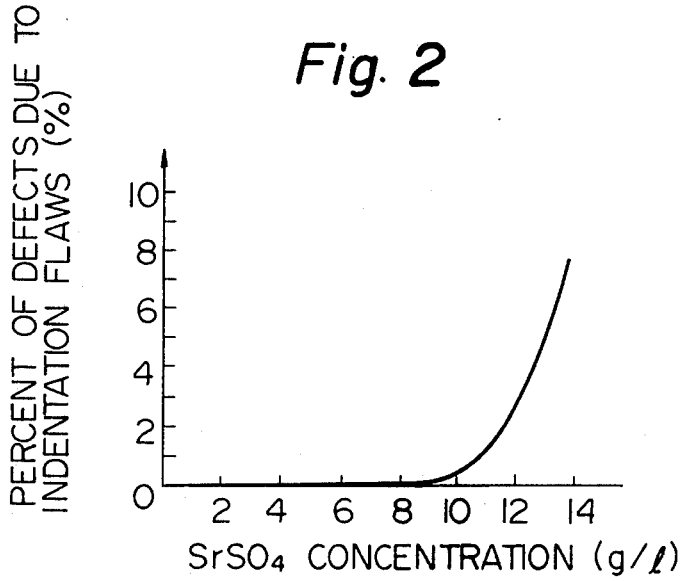

FIG. 2 is a graph showing the relation between the percent of defects due to the occurence of indentation flaws during the plating operation and the concentration of $SrSO_4$ in the electrolyte. As is apparent from the graph in FIG. 2, the percent of defects in the plated steel strips markedly increases when the concentration of $SrSO_4$ exceeds 10 g/l.

Therefore, the present invention defines the content of $SrSO_4$ in the electrolyte as 0.05–10 g/l.

In carrying out the present invention, it is preferable to use the following conditions: $Zn^{2+}$ ion content in the electrolyte of 10–130 g/l, the $Ni^{2+}$ ion content of 20–140 g/l, a bath temperature of 40–70° C., pH of the electrolyte bath of 1.0–4.5 and current density of 4.0–70 A/dm$^2$.

The presence of $Zn^{2+}$ ions and $Ni^{2+}$ ions in amounts outside of the preferred ranges mentioned leads to increased surface roughness due to insufficient supply of these ions to compensate the consumed $Zn^{2+}$ ions and $Ni^{2+}$ ions on the cathode surface. Under these conditions, the current efficiency is also decreased. The upper limits of these concentrations are respective saturation points in the electrolyte.

The temperature of the plating bath is adjusted to within the range of 40°–70° C. At a lower temperature, the nickel content in the deposited coating decreases, increasing the surface roughness and impairing resistance to corrosion. Furthermore, a higher temperature operation requires more thermal energy, making the operation less economical.

The pH of the plating bath is maintained within the range of 1.0–4.5. At a lower pH bubbles remain on the plating and the electrical efficiency decreases. On the other hand, at a pH higher than 4.5, the nickel content in the deposited coating increases and the surface turns black and sandy.

The current density is preferably defined as 4.0–70 70 A/dm$^2$. At a current density lower than 4.0 A/dm$^2$, the nickel content in the deposited coating increases, lowering the resistance to corrosion. At a current density higher than 70 A/dm$^2$, the nickel content also increases, rendering the plating less resistant to corrosion.

The nickel content in the plating is preferably is 6.5–24% by weight. A lower nickel content means the formation of too much Zn-solid solution phase ($\eta$-phase) in the deposited alloy. This results in decreased surface brightness and poor resistance to corrosion. On the other hand, the higher the nickel content in the alloy the more the formation of Ni-solid solution phase ($\alpha$-phase) in the deposited alloy. This also results in decrease in surface brightness and less resistance to corrosion.

EXAMPLE:

A cold rolled steel strip (0.8 mm thick × 1219 mm wide) was electroplated in accordance with the present invention under the following plating conditions.

(1) Electrolyte:
1 g/l of Sr in the form of $SrSO_4$ ($SrSO_4$ content 1.24 g/l) was added to a solution containing 125 g/l of $ZnSO_4.7H_2O$ and 265 g/l of $NiSO_4.6H_2O$.

(2) pH of the electrolyte:
2.2

(3) Bath temperature:
60° C.

(4) Current density:
30 A/dm$^2$ (5) Feed rate of steel strip:
60 m/min

After completion of plating, the surface brightness of the plated steel strip was measured in term of surface roughness ($H_{max}$ ($\mu$)) throughout its whole length. For comparison, the experiment was repeated except that a strontium compound was not added to the electrolyte. The surface brightness was also measured.

The steel strip electrolytically plated without the addition of a strontium compound showed a surface roughness ($H_{max}$) in the range of 0.75–1.25$\mu$. Visual inspection showed that the appearance was dull throughout the plated surface. In contrast, the steel strip electrolytically plated with Zn-Ni alloy in accordance with the present invention, i.e. the deposited coatings obtained by using an electrolyte containing $SrSO_4$, had surface roughness in a range of 0.4–0.5$\mu$ ($H_{max}$) and had excellent brightness.

Thus, according to the present invention, an improved Zn-Ni alloy plating can be obtained merely by adding $SrSO_4$ to the electrolyte bath. The operation for this purpose can be carried out in a very simple manner and at a very low cost. In addition, since the operational stability is remarkable, the present invention for the first time can provide a practical method of electrolytically plating a steel strip with a Zn-Ni alloy on an industrial scale.

What is claimed is:

1. A method of electrolytically plating a steel strip with a Zn-Ni alloy in an electrolyte bath containing $Zn^{2+}$ ions in an amount of 10–130 g/l, $Ni^{2+}$ ions in an amount of 20–140 g/l at a current density of 4.0–70 A/dm$^2$, at a temperature of 40°–70° C. at a pH of 1.0–4.5, characterized by adding a strontium compound in an amount of 0.05–10 g/l, calculated as $SrSO_4$, to the electrolyte.

2. A method as defined in claim 1, in which the strontium compound is added in the form of $SrSO_4$.

* * * * *